US009687089B2

(12) United States Patent
Chikkakalbalu et al.

(10) Patent No.: US 9,687,089 B2
(45) Date of Patent: Jun. 27, 2017

(54) INSULATED FOAM PANELS FOR REFRIGERATED DISPLAY CASES

(71) Applicant: Heatcraft Refrigeration Products LLC, Richardson, TX (US)

(72) Inventors: Chandrashekhara Chikkakalbalu, Columbus, GA (US); Kevin Simmons, Phenix City, AL (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 0 days.

(21) Appl. No.: 14/541,341

(22) Filed: Nov. 14, 2014

(65) Prior Publication Data

US 2015/0137670 A1 May 21, 2015

Related U.S. Application Data

(60) Provisional application No. 61/905,303, filed on Nov. 18, 2013.

(51) Int. Cl.

| | |
|---|---|
| ***A47F 3/00*** | (2006.01) |
| ***A47F 3/04*** | (2006.01) |
| *F25D 23/06* | (2006.01) |

(52) U.S. Cl.

CPC ..... *A47F 3/0482* (2013.01); *F25D 23/063* (2013.01); *Y10T 428/233* (2015.01); *Y10T 428/24777* (2015.01)

(58) Field of Classification Search

CPC ..... A47F 3/0426; A47F 3/0482; A47F 3/04; A47F 3/0439; A47F 3/0443; A47F 3/0447

USPC ..... 312/116, 401, 400, 406, 406.1, 406.2; 428/71, 60; 52/784.15, 784.1, 794.1, 52/309.9

See application file for complete search history.

(56) References Cited

U.S. PATENT DOCUMENTS

| | | | | |
|---|---|---|---|---|
| 3,230,681 | A * | 1/1966 | Allen et al. | 52/309.9 |
| 3,446,692 | A * | 5/1969 | Turnbull | E04C 2/36 156/79 |
| 3,877,765 | A * | 4/1975 | Hassing | 312/265.4 |
| 4,924,565 | A * | 5/1990 | Rathjen | A61G 17/02 27/11 |
| 5,459,498 | A * | 10/1995 | Seccombe et al. | 347/18 |
| 5,475,987 | A * | 12/1995 | McGovern | 62/256 |
| 5,501,516 | A * | 3/1996 | Federico | 312/116 |
| 7,263,843 | B1 * | 9/2007 | Nordstrom | 62/78 |
| 8,820,034 | B1 * | 9/2014 | Watts et al. | 52/838 |
| 2003/0009966 | A1 * | 1/2003 | Rieke | E04C 2/292 52/309.8 |
| 2003/0225172 | A1 * | 12/2003 | Miller | B29C 44/3403 521/50 |
| 2007/0163197 | A1 * | 7/2007 | Payne et al. | 52/586.1 |
| 2007/0204557 | A1 * | 9/2007 | Timbrook | 52/749.1 |
| 2008/0211367 | A1 * | 9/2008 | Decker et al. | 312/401 |
| 2011/0064938 | A1 * | 3/2011 | Breindel | B82Y 30/00 428/315.5 |

(Continued)

FOREIGN PATENT DOCUMENTS

WO 2009/015673 * 2/2009

*Primary Examiner* — Janet M Wilkens

(74) *Attorney, Agent, or Firm* — Hubbard Johnston, PLLC

(57) ABSTRACT

An insulated foam panel for a refrigerated display case is presented. The insulated foam panel may include a polyurethane foam core, a number of polystyrene support rails surrounding the polyurethane foam core in whole or in part, and a pair of liners positioned about the polyurethane foam core.

17 Claims, 27 Drawing Sheets

(56) References Cited

U.S. PATENT DOCUMENTS

| | | | | |
|---|---|---|---|---|
| 2011/0165368 | A1* | 7/2011 | Hsu | 428/71 |
| 2012/0104002 | A1* | 5/2012 | Jung et al. | 220/592.27 |
| 2012/0292277 | A1 | 11/2012 | Chikkakalbalu | |
| 2013/0195544 | A1* | 8/2013 | Sanders et al. | 403/268 |

* cited by examiner

INSULATED FOAM PANELS FOR REFRIGERATED DISPLAY CASES

RELATED APPLICATIONS

The present application is a non-provisional application that claims the benefit of provisional application Ser. No. 61/905,303, filed on Nov. 18, 2013. Provisional application Ser. No. 61/905,303 is incorporated herein by reference in full.

TECHNICAL FIELD

The present application and the resultant patent relate generally to modular refrigeration systems and more particularly relate to modular refrigeration systems such as refrigerated display cases with insulated foam panels having improved energy efficiency with lower manufacturing and operating costs.

BACKGROUND OF THE INVENTION

Refrigerated display cases and other types of refrigeration units may include a number of foam panels connected at a number of joints. Each panel typically may include a standard low density polystyrene core surrounded by an expanded polyvinyl chloride frame and enclosed within a pair of thin metal skins or liners. For example an existing refrigerated display case may use six (6) panels that may be about two (2) inches in thickness and assembled with a number of joints and other types of support elements. A typical thermal resistance value R for such a refrigerated display case may be about 12.13 or so. The thermal resistance value R of a material may be the thickness of the material divided by the thermal conductivity as expressed in $ft^2 \cdot {}^\circ F \cdot hr/Btu$ (or $K\text{-}m^2/W$). Known issues with such refrigerated display cases may include heat loss through the joints, condensation at higher ambient dew point temperatures, and relatively low energy efficiency.

There is thus a desire for an improved refrigerated display case. Such a refrigerated display case may include insulated foam panels with higher thermal resistance values for improved energy efficiency with fewer parts and overall lower construction and operating costs.

SUMMARY OF THE INVENTION

The present application and the resultant patent thus provide an insulated foam panel for a refrigerated display case. The insulated foam panel may include a polyurethane foam core, a number of polystyrene support rails surrounding the polyurethane foam core in whole or in part, and a pair of liners positioned about the polyurethane foam core.

The present application and the resultant patent further provide a refrigerated display case. The refrigerated display case may include a back panel and a canopy panel. The back panel and the canopy panel may include a polyurethane foam core and a number of polystyrene support rails surrounding the polyurethane foam core in whole or in part.

The present application and the resultant patent further provide a refrigerated display case. The refrigerated display case may include a unitary back panel and a unitary canopy panel. The unitary back panel and the unitary canopy panel may include a polyurethane foam core with a thermal resistance value R of about 13.0 to about 13.5 and a number of polystyrene support rails surrounding the polyurethane foam core in whole or in part.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
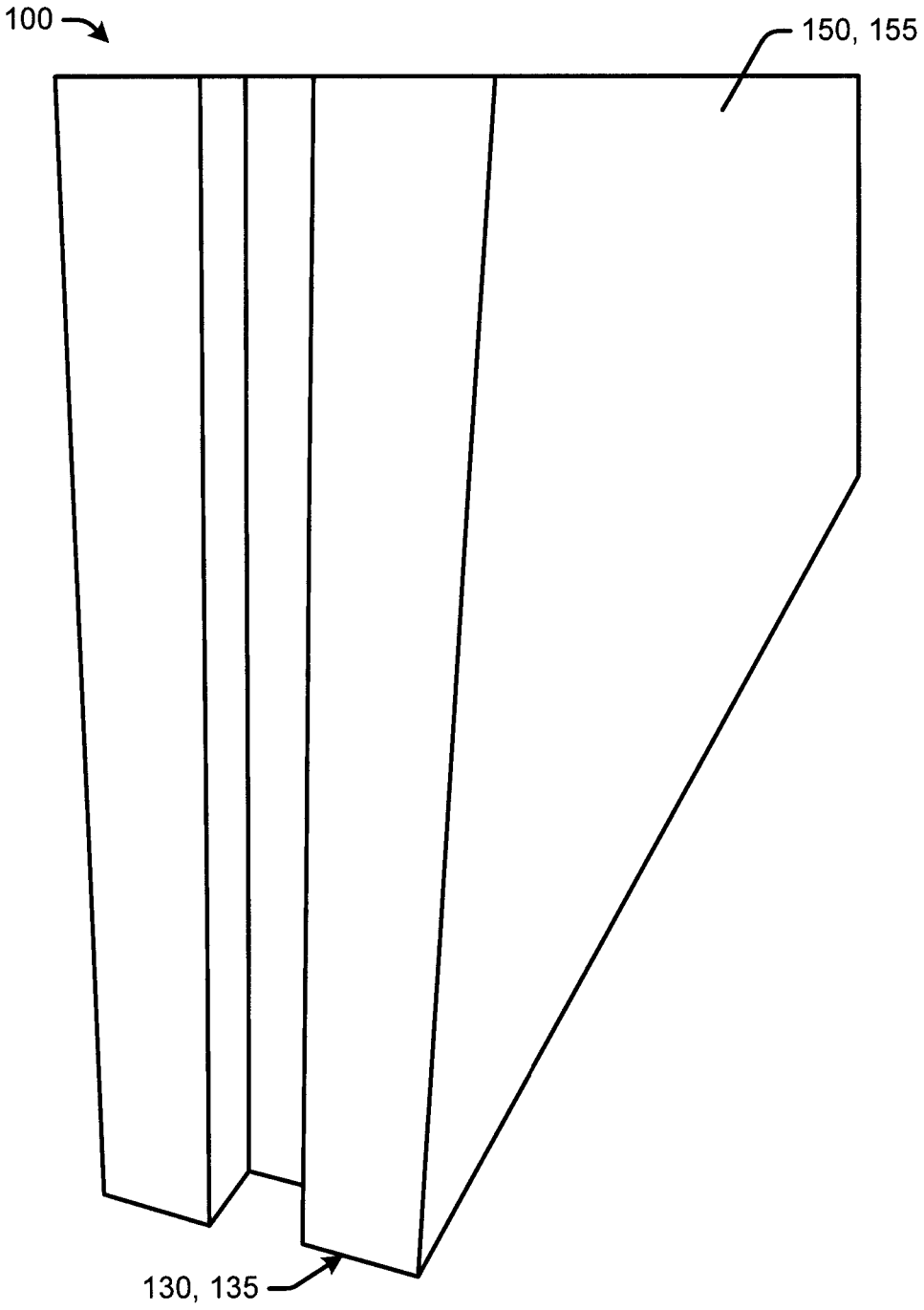
FIG. 1 is a perspective view of a portion of an insulated foam panel as may be described herein.
Figure 2:
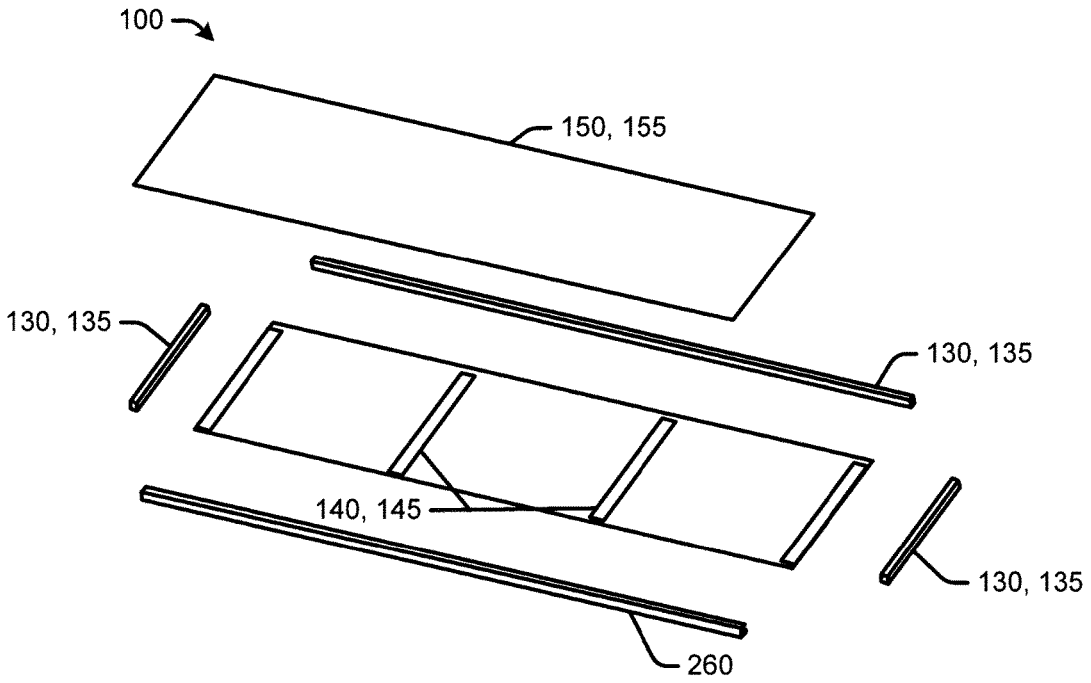
FIG. 2 is an exploded view of a portion of the insulated foam panel of FIG. 1.
Figure 3:
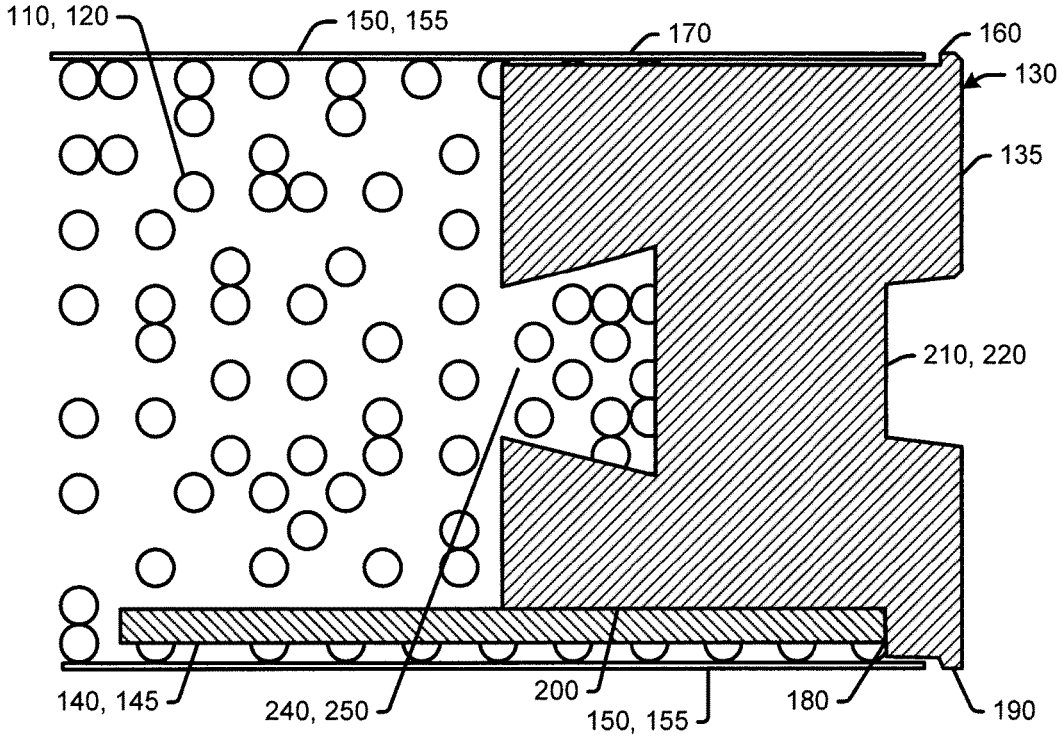
FIG. 3 is a sectional view of a portion of the insulated foam panel of FIG. 1.

Referring now to the drawings, in which like numerals refer to like elements throughout the several views, FIGS. 1-3 show an example of an insulated foam panel 100 as may be described herein. The insulated foam panel 100 may have any size, shape, or configuration. The insulated foam panel 100 may include a foam core 110. The foam core 110 may be made out of a polyurethane foam 120. The polyurethane foam 120 may have a thermal resistance value R of about 13.3 or so. Other thermal resistance values R may be used herein. The polyurethane foam 120 may be injected into the insulated foam panel 100 once the structural elements described below are assembled in whole or in part. Other types of foams with good insulating characteristics also may be used herein.

The insulated foam panel 100 may be surrounded, in whole or in part, by a number of extended support rails 130. These support rails 130 may be made out of a high density Styrofoam (polystyrene) 135 and the like with good thermal resistance values. For example, a high density polystyrene 135 may have a thermal resistance value R of about 10 or so. Other thermal resistance values R may be used herein. The support rails 130 may have any size, shape, or configuration. Support rails 130 of differing configurations also may be used herein together. Examples of the configuration of the support rails 130 will be described in more detail below.

The insulated foam panel 100 may include a number of reinforcement plates 140. The reinforcement plates 140 may run for some or all of the length of the insulated foam panel 100 in one or more directions. The reinforcement plates 140 may be made from scrap metal 145 and the like. The reinforcement plates 140 may have any size, shape, or configuration. The insulated foam panel 100 may be enclosed on one or both sides by a liner 150. The liners 150 may extend between the support rails 130 along the length of the insulated foam panel 100 in whole or in part. The liners 150 may have any size, shape, or configuration. The liners 150 may be made out of thin metals 155 and the like. The liners 150 also may be made out of structoglass or various types of composite materials. Other components and other configurations also may be used herein.

Referring again to FIG. 3, an example of the support rail 130 is shown. Each support rail 130 may be an elongated structure depending upon the length and/or width of the insulated foam panel 100. One or both ends of the support rail 130 may have a first liner flange 160 on a first side 170 thereof. The first liner flange 160 may be sized to accommodate the thickness of the liner 150 therein. One or both ends of the support rail 130 also may include a reinforcement plate flange 180 and a second liner flange 190 on a second side 200 thereof. The reinforcement plate flange 180 may be sized to accommodate the reinforcement plate 140 while the second liner flange 190 may be sized to accommodate the liner 150. Specifically, the respective flanges 160, 180, 190 may be sized to accommodate the liners 150 and the reinforcement plate 140 along with an amount of the polyurethane foam 120 so as to provide good sealing and structural support. The overall profile of the support rails 130 thus allows liner tolerance and the flow of the foam between the support rails 130 and the liners 150 to provide bondage therein.

Figure 4:
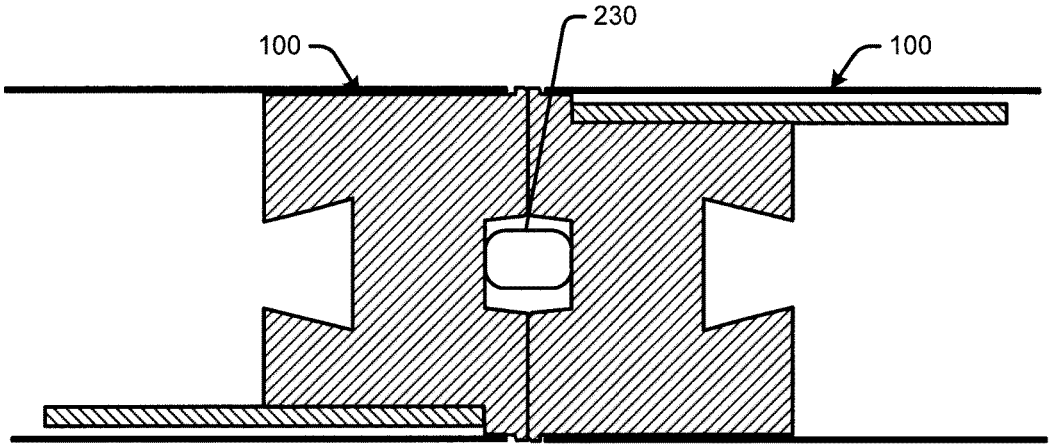
FIG. 4 is a sectional view of two (2) insulated foam panels joined at a foam gasket.
Figure 5:
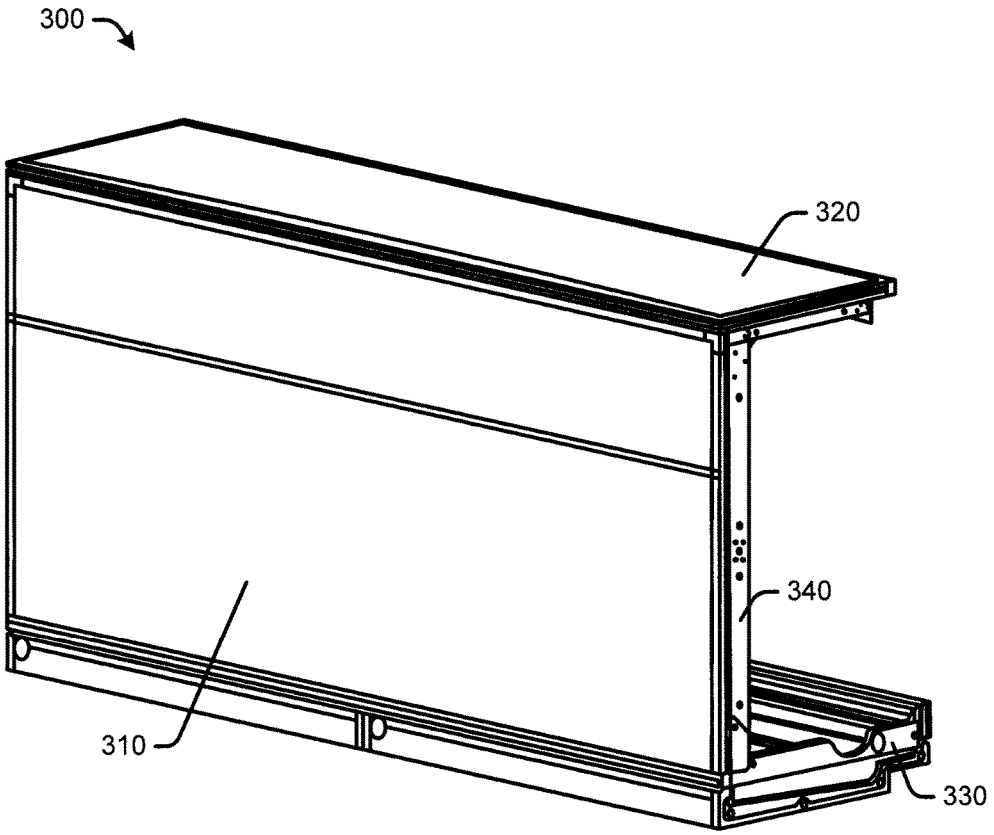
FIG. 5 is a rear perspective view of a refrigerated display case as may be described herein.
Figure 6A:
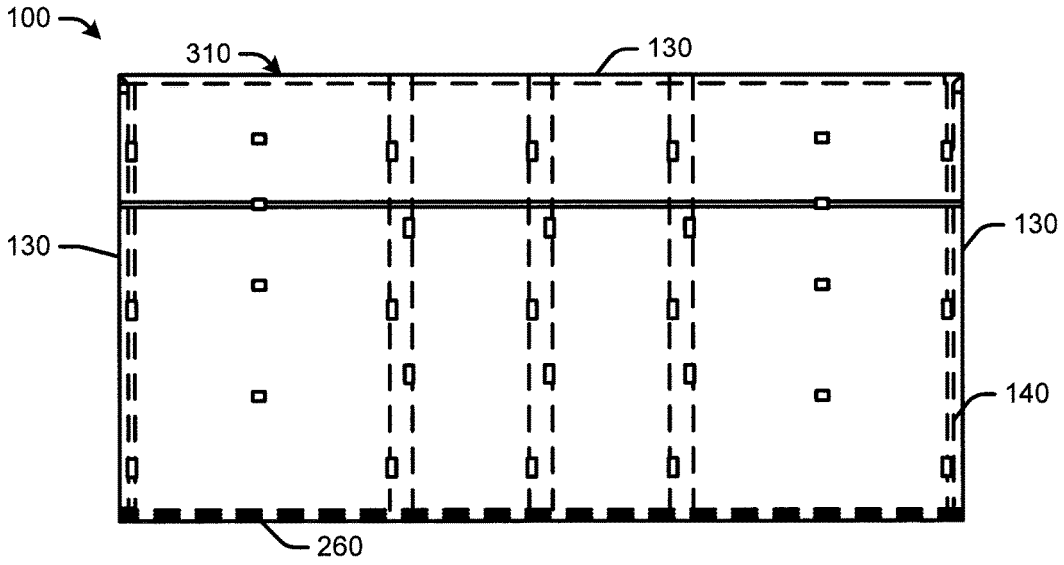
FIG. 6A is a plan view of a back panel of the refrigerated display case of FIG. 5.
Figure 6B:
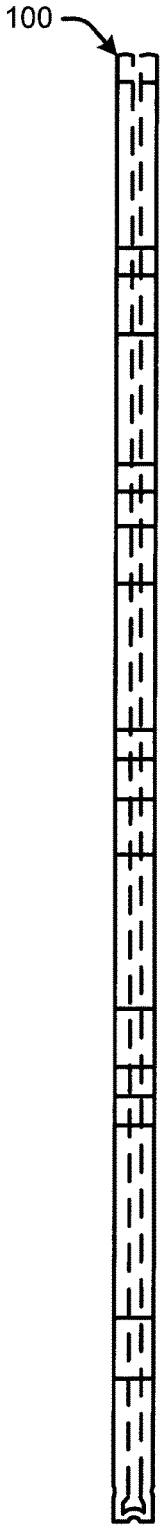
FIG. 6B is a side plan view of the back panel of FIG. 6A.
Figure 6C:
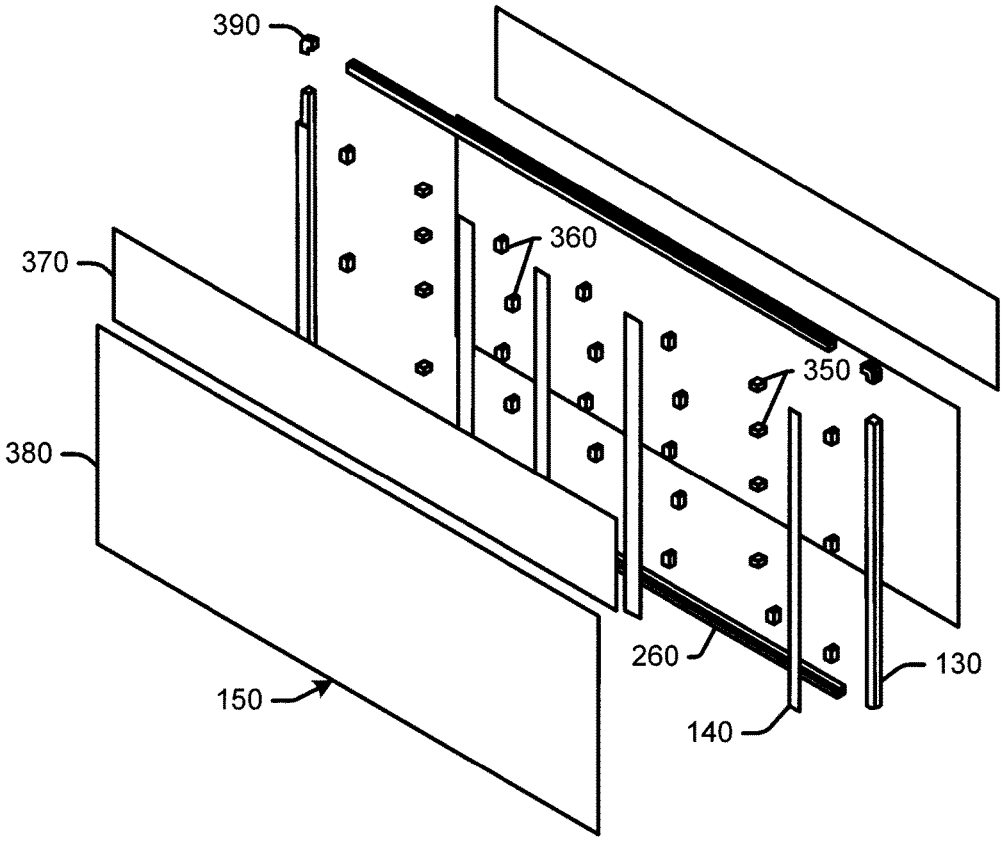
FIG. 6C is an exploded view of the back panel of FIG. 6A.
Figure 6D:
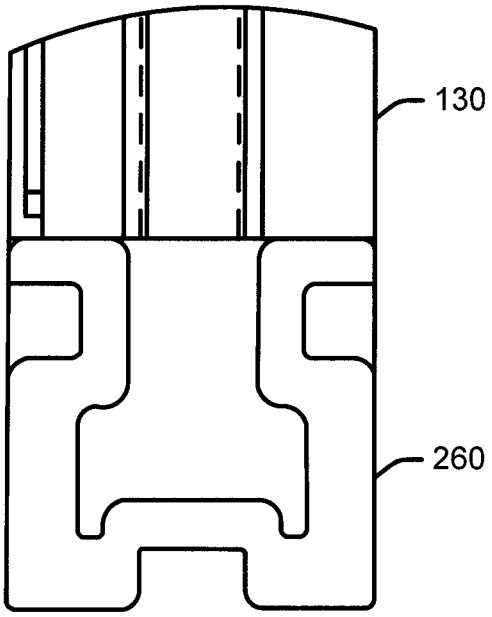
FIG. 6D is a partial plan view of a rail used with the back panel of FIG. 6A.
Figure 6E:
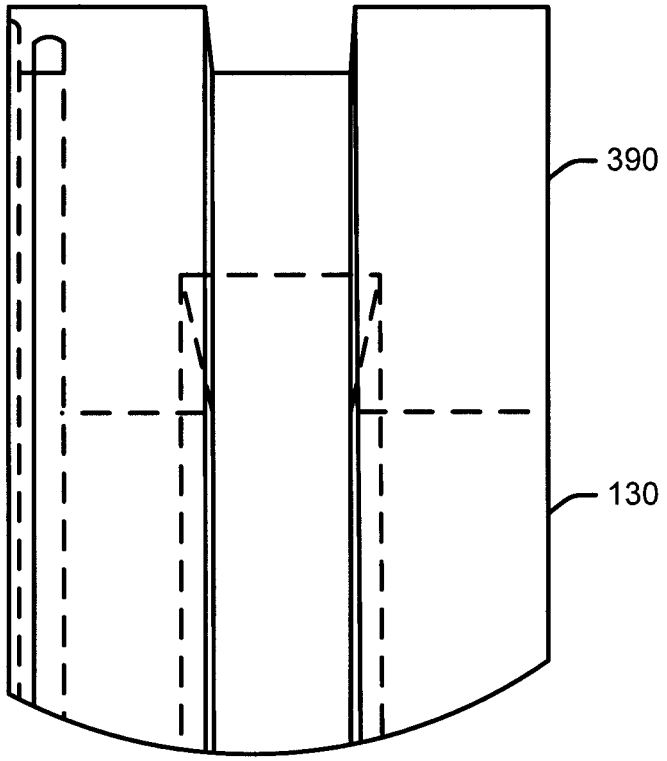
FIG. 6E is a partial plan view of the rail used with the back panel of FIG. 6A.
Figure 6F:
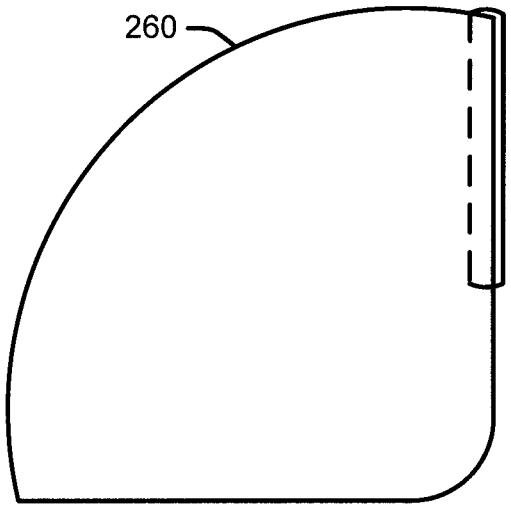
FIG. 6F is a partial plan view of the rail used with the back panel of FIG. 6A.
Figure 6G:
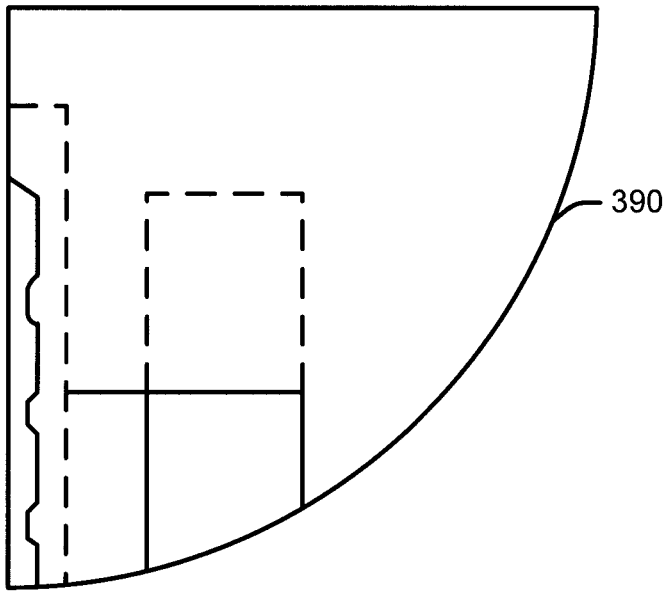
FIG. 6G is a partial plan view of the rail used with the back panel of FIG. 6A.

The support rail 130 may have a gasket slot 210 on a third side 220 thereof. As is shown in FIG. 4, a foam gasket 230 may be positioned therein so as to join together a pair of the insulated foam panels 100. Any number of the insulated foam panels 100 may be joined. The support rail 130 also may have a foam slot 240 on a fourth side 250 thereof so as to accommodate the polyurethane foam 120 therein. A protective coating or film may be applied to the support rails 130 for protection against damage during handling or assembly. Color also may be applied for a pleasing appearance. Other components and other configurations may be used herein. A conventional polyvinyl chloride rail 260 also may be used at the bottom of the insulated foam panel 100 so as to accommodate existing attachment features and the like.

The insulated foam panel 100 described herein thus uses the high density polystyrene 135 as the support rails 130, the scrap metal 145 as the reinforcement plates 140, and the thin metal 155 as the liners 150 positioned about the polyurethane foam 120 of the foam core 110. The polyurethane foam 120 provides good foam flow for better integrity, high thermal resistance values, and structural strength. Specifically, the flow of the polyurethane foam 120 over the liners 150, the reinforcement plates 140, and the other components ensures a strong bond between all of the components of the panel 100. The use of the support rails 130 with the high density polystyrene 135 allows for the positive placement of the liners 150 therein. Moreover, the high density polystyrene 135 may be compressed so as to provide better sealing at the joints thereof. The scrap metal as the reinforcement plate 140 provides increased structural strength with a further reduction in costs. The insulated foam panel 100 thus may provide high energy efficiency but with lower costs and improved processing.

The thermal resistance value R of a typical insulated foam panel 100 with about two (2) inches in thickness thus may be about 13.26. Other thermal resistance values R may be used herein. The reduction in overall material costs may be about twenty-five percent (25%) or more. Improved processes may be provided by controlling the placement of the liners 150, the reinforcement plates 130, and the foam core 110 by the design features of the support rails 130. Specifically, the profile of the support rails 130 ensures that the liners 150 are placed in the appropriate flanges such that the liners 150 do not extend beyond the support rails 130 or expose a sharp end to the liners 150. The profile also assists in tight contact between two adjacent panels 100 given the compressibility of the polystyrene. Moreover, the gasket 230 therebetween prevents air from escaping between the panels 100. Given such, the use of the support rails 130 may result in a better overall appearance and a higher quality product. Other components and other configurations may be used herein.

FIGS. 5-11 show an example of a refrigerated display case 300 as may be described herein. The refrigerated display case 300 may have any overall size, shape, or configuration. The refrigerated display case 300 may include a number of the insulated foam panels 100 as described above. In this example, two (2) insulated foam panels 100 may be used, a back panel 310 and a canopy panel 320. The refrigerated display case 300 also may include a tub 330 or other type of structure so as to accommodate the refrigeration equipment therein. The refrigerated display case 300 further may include a number of support elements 340. The support elements 340 may be used to support the insulated foam panels 100 and the other components of the refrigerated display case 300. The tub 330 and the support elements 340 may be of conventional design. Other components and other configurations may be used herein.

FIGS. 6A-6G, FIG. 7A, FIG. 7B, and FIGS. 8A-8C show the components of an example of the back panel 310. The back panel 310 may have any size, shape, or configuration. The back panel 310 is of a unitary or one piece design. In addition to the foam core 110, the support rails 130 on the upper end and the sides thereof, the reinforcement plates 140, and the liners 150 as described above, the back panel 310 also may use the conventional rail 260 at the lower end thereof. The back panel 310 further may include a number of liner spacers 350 and tapping plate spacers 360. The spacers 350, 360 may be of conventional design. In this example, the liner 150 may be in the form of an upper liner 370 and a lower liner 380. The liners 370, 380 may overlap to some extent. One of the liner spacers 350 may align with the overlap so as to provide structural support. Other components and other configurations may be used herein.

Figure 7A:
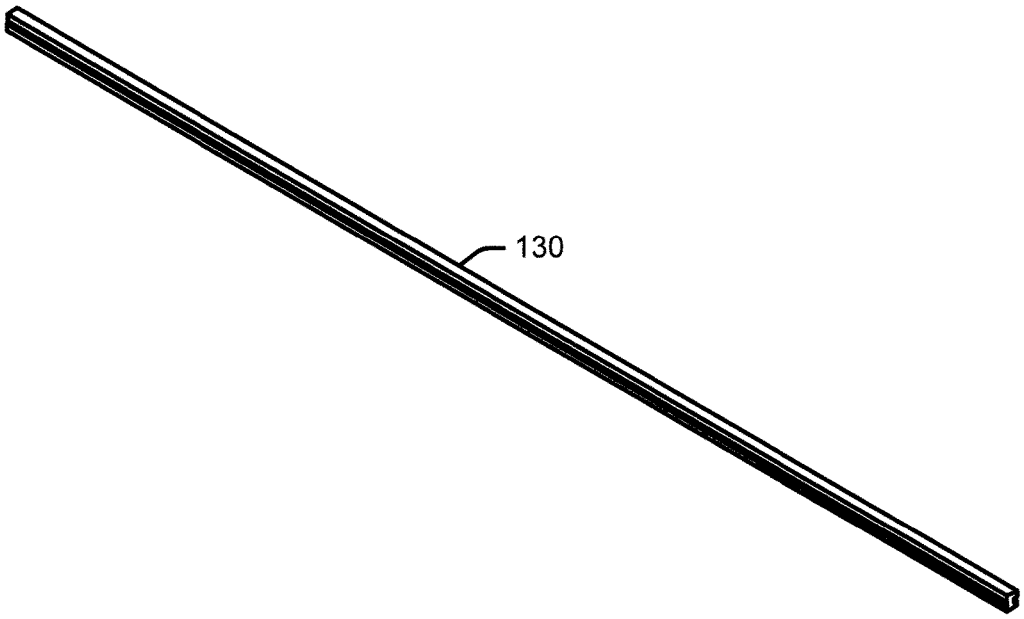
FIG. 7A is a further perspective view of a rail used with the back panel of FIG. 6A.
Figure 7B:
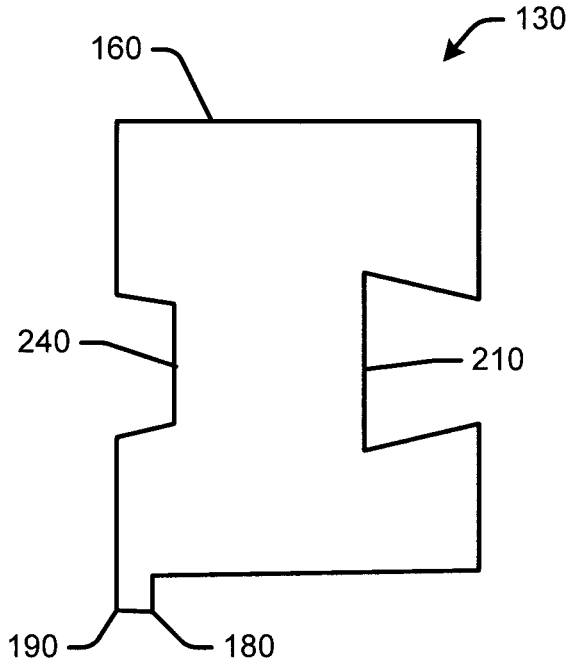
FIG. 7B is a side view of the rail of FIG. 7A.
Figure 8A:
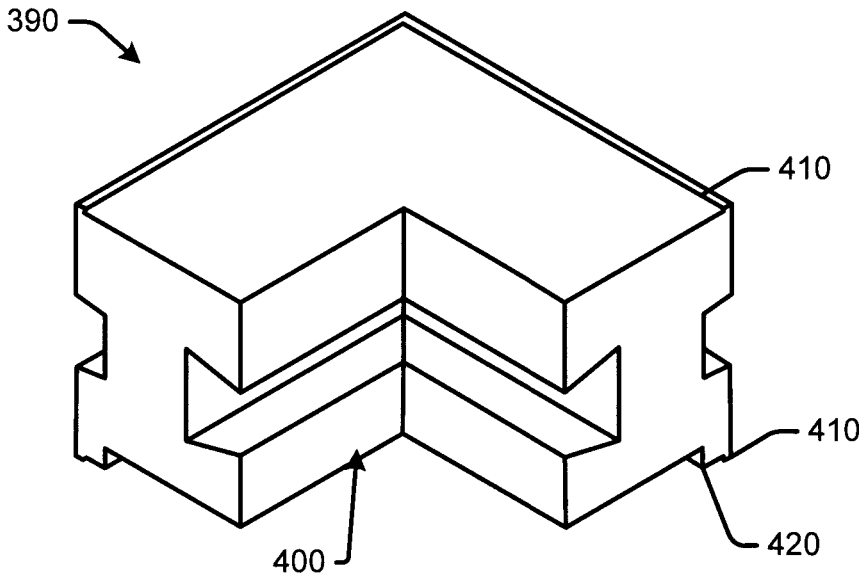
FIG. 8A is a perspective view of a corner piece for use with the back panel of FIG. 6A.
Figure 8B:
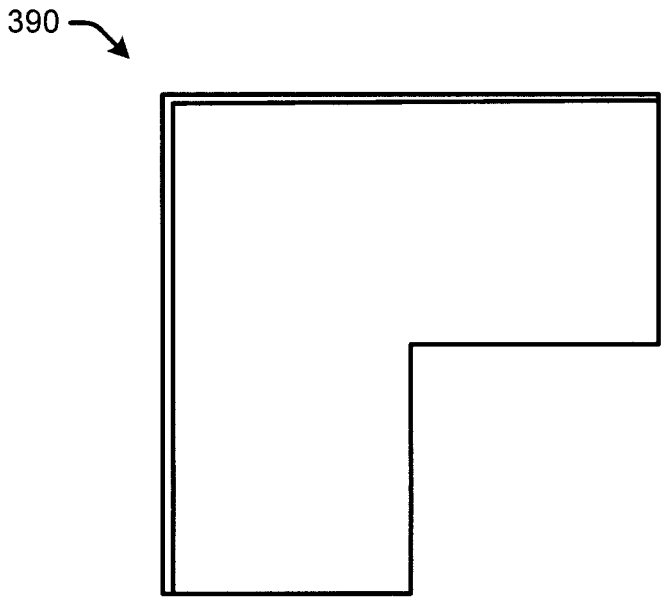
FIG. 8B is a top plan view of the corner piece of FIG. 8A.
Figure 8C:
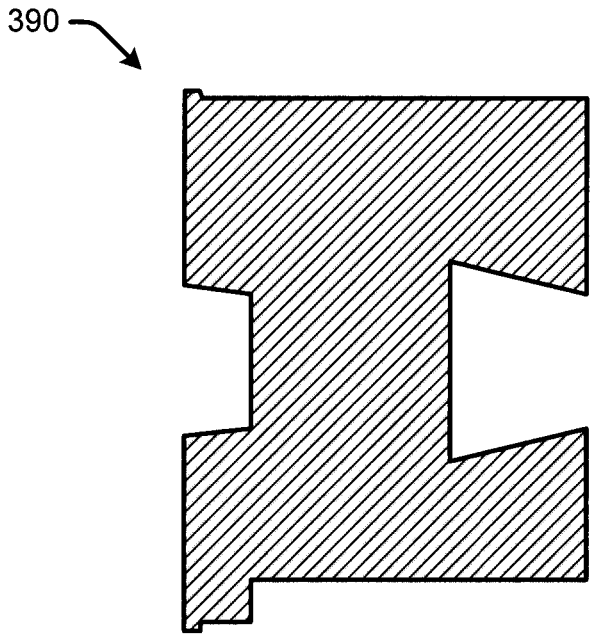
FIG. 8C is a sectional view of the corner piece of FIG. 8A.
Figure 9A:
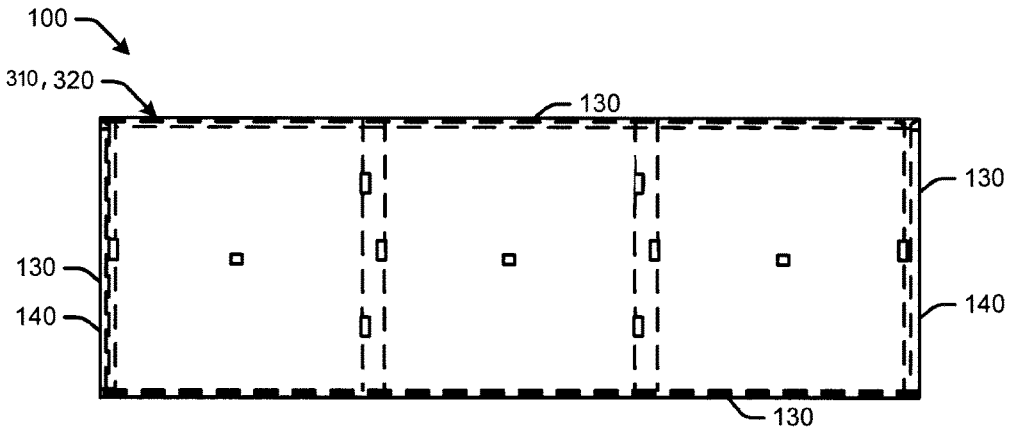
FIG. 9A is a plan view of a canopy panel for use with the refrigerated display case of FIG. 5.
Figure 9B:
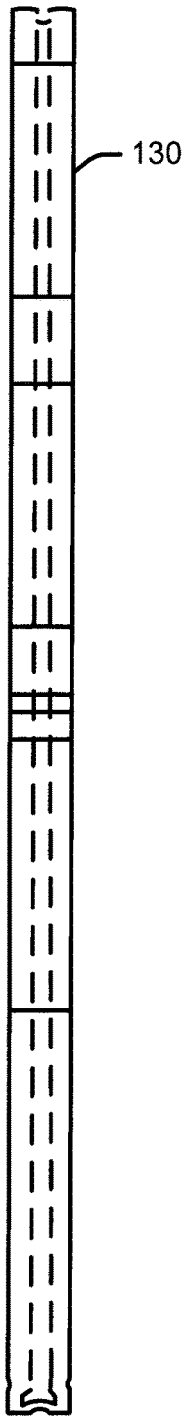
FIG. 9B is a side plan view of the canopy panel of FIG. 9A.
Figure 9C:
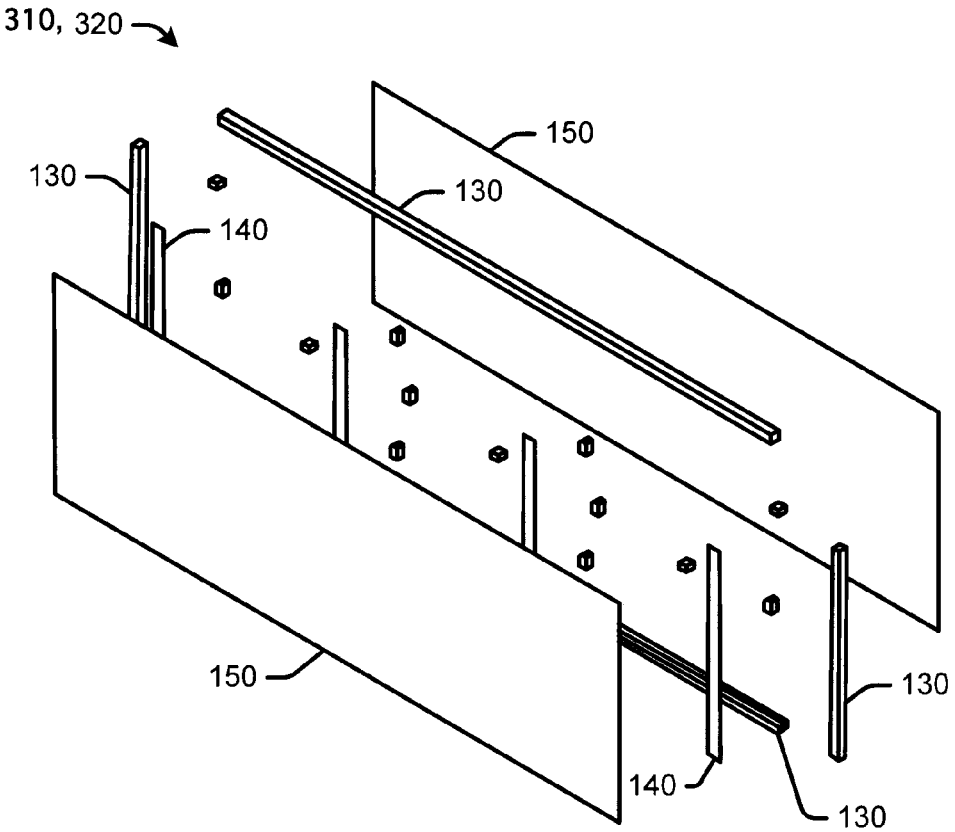
FIG. 9C is an exploded view of the canopy panel of FIG. 9A.
Figure 9D:
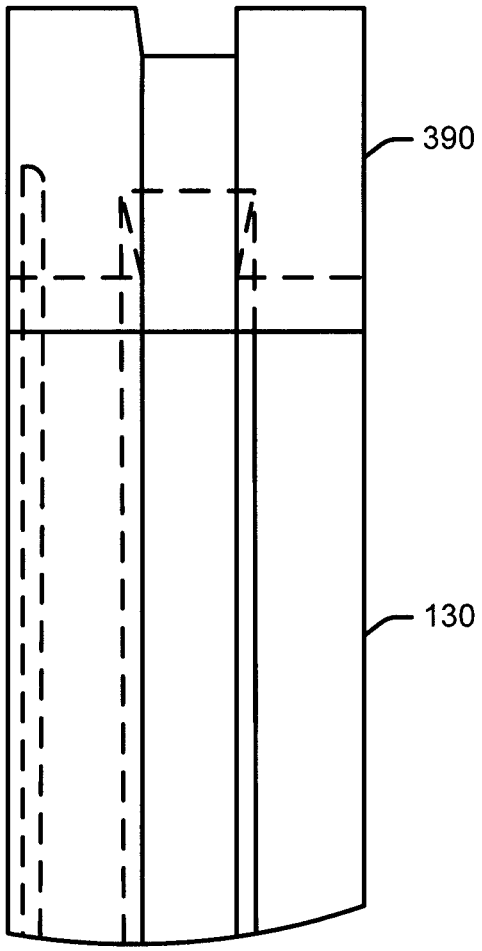
FIG. 9D is a partial plan view of a rail for use with the canopy panel of FIG. 9A.
Figure 9E:
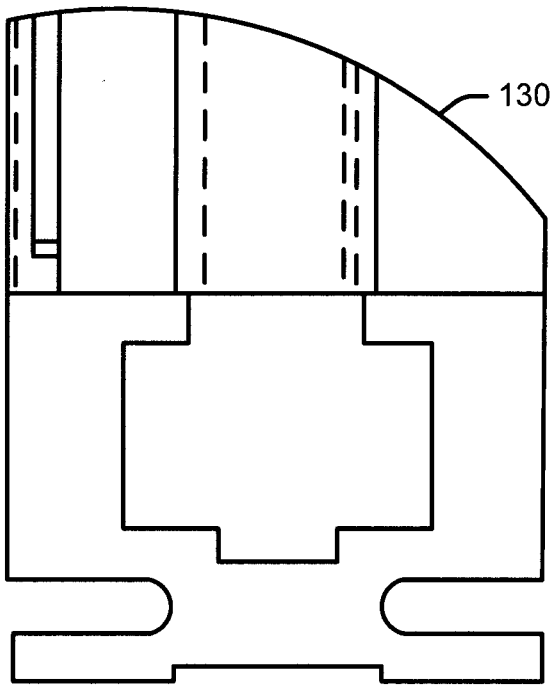
FIG. 9E is a partial plan view of the rail for use with the canopy panel of FIG. 9A.
Figure 9F:
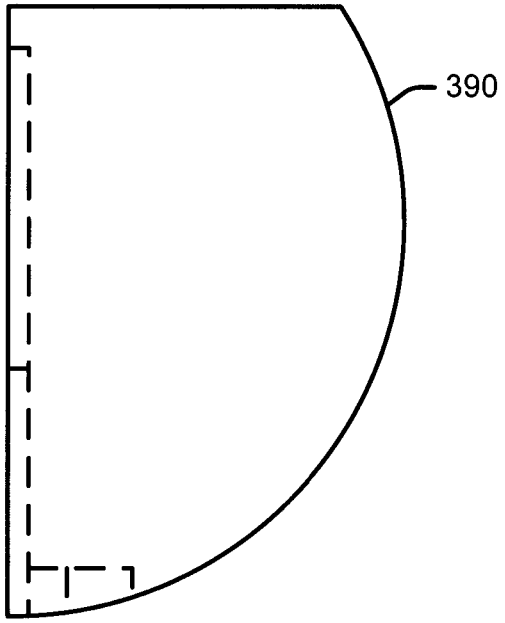
FIG. 9F is a partial plan view of the rail used with the canopy panel of FIG. 9A.
Figure 9G:
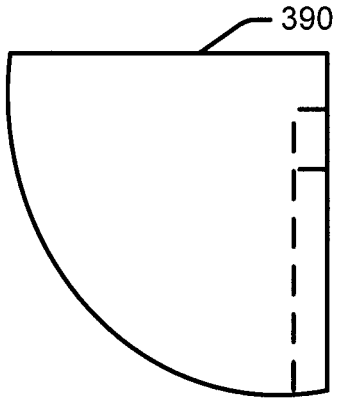
FIG. 9G is a partial plan view of the rail used with the canopy panel of FIG. 9A.
Figure 10A:
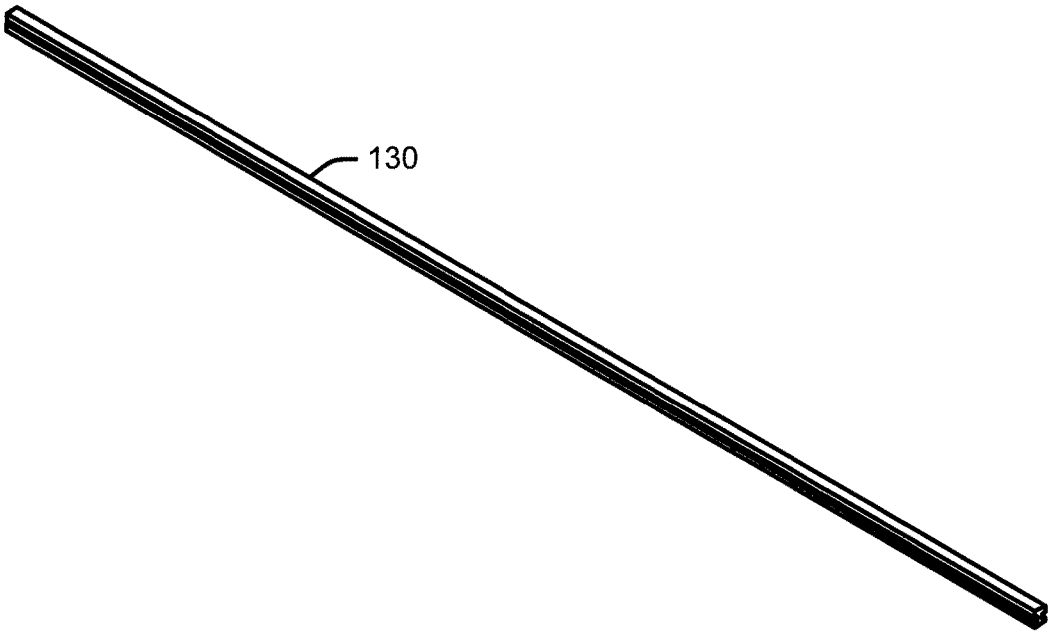
FIG. 10A is a further perspective view of a rail used with the canopy panel of FIG. 9A.
Figure 10B:
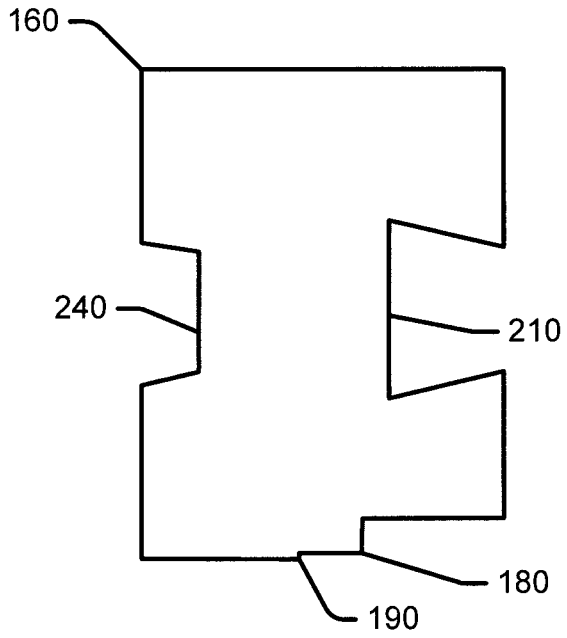
FIG. 10B is a sectional view of the rail of FIG. 10A.

An example of the support rails 130 as used in the back panel 310 may be shown in FIGS. 7A and 7B. The pair of support rails 130 running in the vertical orientation may be connected to the support rail 130 running in the horizontal orientation via a pair of corner parts 390. As is shown in FIGS. 8A-8C, the corner parts 390 may have a generally seamless ninety degree (90°) turn 400 along with a pair of liner flanges 410 and a reinforcement plate flange 420. Other angles may be used herein. The corner parts 390 may be sized to accommodate the support rails 130. Alternatively, the corner parts 390 and the support rail 130 may have a unitary construction. The corner parts 390 may have any size, shape, or configuration. The corner parts 390 provide a continuous profile on all sides for smooth foam flow and appearance. The back panel 310 may be attached to the structural elements 340 via the reinforcement plates 140 or elsewhere. Conventional attachment means may be used.

Figure 11:
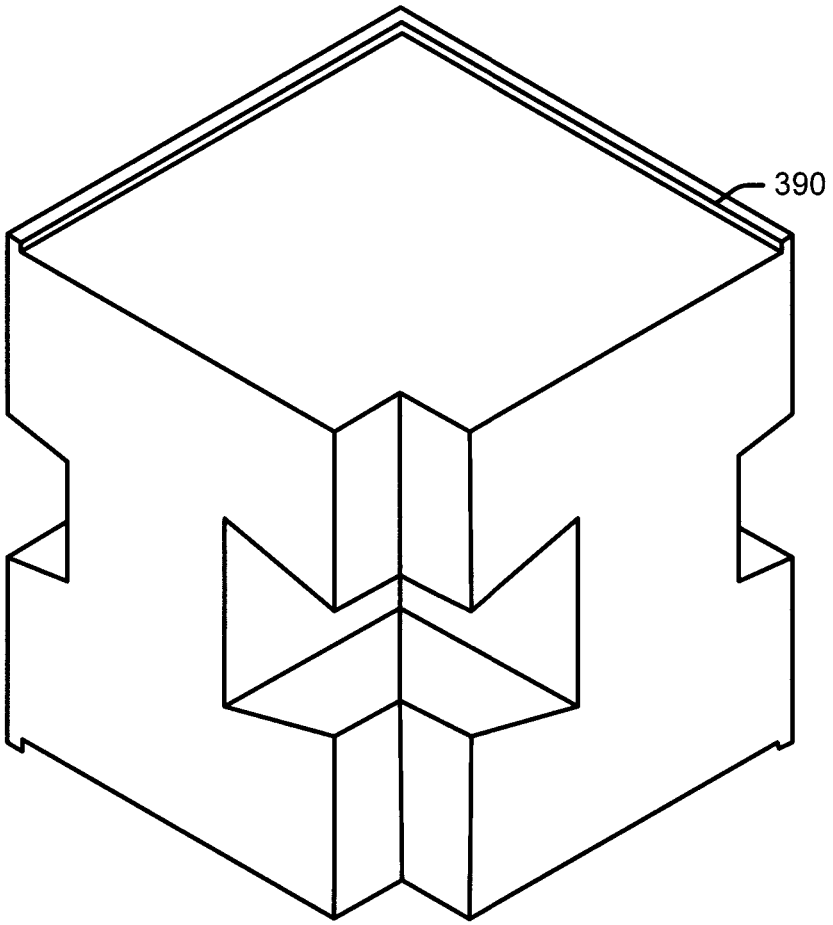
FIG. 11 is a perspective view of a corner piece.

FIGS. 9A-9G, FIG. 10A, and FIG. 10B show the components of an example of the canopy panel 320 or again a back panel 310. The canopy panel 320 may have an overall construction similar to that described above with respect to the back panel 310 and the like. The canopy panel 320 may have any size, shape, or configuration. The canopy panel 320 may have a unitary or a one piece design. The canopy panel 320 typically will be somewhat smaller in size as compared to the back panel 310 although any size may be used herein. The canopy panel 320 may be attached to the structural elements 340 via the reinforcement plates 140. Conventional attachment means may be used. As is shown in FIG. 11, corner parts 390 with other configurations also may be used herein. Other components and other configurations may be used herein.

The use of the insulated foam panels 100 described herein thus provide the refrigerated display case 300 with increased energy efficiency, increased structural strength, and lower overall cost manufacturing and operational costs. For example, by only using two (2) of the insulated foam panels 310, 320 as compared to the conventional six (6) foam panels described above, the refrigerated display case 300 limits or avoids the loss of cooling air via the multiple joints between the panels. Moreover, the energy efficiency may be increased via the higher thermal resistance R values of the polyurethane foam 120 in the foam core 110. Likewise, condensation on the outer surfaces of the liners 150 may be reduced given the improved insulating characteristics of the polyurethane foam 120 and the reduction in the joints.

Although the insulated foam panels 100 described herein have been discussed in the context of the refrigerated display case 300, the insulated foam panels 100 also could be used in heating applications or in any application within or outside of the refrigeration industry where insulated panels and the like may be needed to or benefit from overall minimized heat transfer therethrough. Other applications also may be used herein.

According to an illustrative embodiment, an insulated foam panel for forming at least a portion of a wall of a refrigerated display case includes a polyurethane foam core and a rail frame having four rectilinear exterior sides forming a perimeter. The rail frame includes a plurality of polystyrene support rails and at least one bottom rail. The polyurethane foam is disposed in an interior of the rail frame; that is, the rails form an interior and surround the foam core. The insulated foam panel further includes a pair of liners positioned about the polyurethane foam core; a plurality of liner spacers extending between the pair of liners; and a plurality of reinforcement plates positioned about the polyurethane foam core. Each of the reinforcement plates of the plurality of reinforcement plates extends from one of the rectilinear exterior sides to another of the rectilinear exterior sides of the rail frame.

According to an illustrative embodiment, a refrigerated display case includes a back panel and a canopy panel. The back panel and the canopy panel include at least one insulated foam panel. The at least one insulted foam panel includes: a rectilinear rail frame having four rectilinear exterior sides forming a perimeter. The rectilinear rail frame includes a plurality of polystyrene support rails and at least one bottom rail. The rectilinear rail frame defines an interior having a first side opening and a second side opening on the other side. The at least one insulated foam panel further includes a first liner positioned to cover the first side opening of the rectilinear rail frame and a second liner positioned to cover the second opening of the rectilinear rail frame. The at least one insulated foam panel further includes a plurality of liner spacers disposed between the first liner and the second liner within the interior; a plurality of reinforcement plates positioned within the interior and extending from one of the rectilinear exterior sides to another of the rectilinear exterior sides of the rail frame; and a polyurethane foam disposed within and filling the interior to form a polyurethane foam core.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. An insulated foam panel for forming at least a portion of a wall of a refrigerated display case, the insulated foam panel comprising:

a polyurethane foam core;

a rail frame having four rectilinear exterior sides forming a perimeter, the rail frame comprising a plurality of polystyrene support rails and at least one bottom rail;

wherein the polyurethane foam is disposed in an interior of the rail frame;

a pair of liners positioned about the polyurethane foam core;

a plurality of liner spacers extending between the pair of liners; and a plurality of reinforcement plates positioned about the polyurethane foam core, wherein each reinforcement plate of the plurality of reinforcement plates extends from one of the rectilinear exterior sides to another of the rectilinear exterior sides of the rail frame.

2. The insulated foam panel of claim 1, wherein the polyurethane foam core comprises a thermal resistance value R of about 12.5 to about 14.0.

3. The insulated foam panel of claim 1, wherein the plurality of polystyrene support rails comprises a thermal resistance value R of about 9.5 to about 10.5.

4. The insulated foam panel of claim 1, wherein the plurality of reinforcement plates comprise scrap metal.

5. The insulated foam panel of claim 1, wherein the pair of liners comprise metal and/or glass.

6. The insulated foam panel of claim 1, wherein the plurality of polystyrene support rails comprises a liner flange sized to accommodate a thickness of one of the pair of liners and a reinforcement plate flange sized to accommodate a thickness of one of the reinforcement plates of the plurality of reinforcement plates.

7. The insulated foam panel of claim 1, wherein the plurality of polystyrene support rails comprises a gasket slot and a gasket therein.

8. A refrigerated display case, comprising:

a back panel;

a canopy panel; and wherein the back panel and the canopy panel comprise at least one insulated foam panel, wherein the at least one insulted foam panel comprises:

a rectilinear rail frame having four rectilinear exterior sides forming a perimeter, the rectilinear rail frame comprising a plurality of polystyrene support rails and at least one bottom rail, the rectilinear rail frame defining an interior having a first side opening and a second side opening, a first liner positioned to cover the first side opening of the rectilinear rail frame, a second liner positioned to cover the second opening of the rectilinear rail frame, a plurality of liner spacers disposed between the first liner and the second liner within the interior, a plurality of reinforcement plates positioned within the interior and extending from one of the rectilinear exterior sides to another of the rectilinear exterior sides of the rail frame, and a polyurethane foam disposed within and filling the interior to form a polyurethane foam core.

9. The refrigerated display case of claim 8, wherein the polyurethane foam core comprises a thermal resistance value R of about 13.0 to about 13.5.

10. The refrigerated display case of claim 8, wherein the plurality of polystyrene support rails comprises a thermal resistance value R of about 10.

11. The refrigerated display case of claim 8, wherein the plurality of reinforcement plates comprise a plurality of scrap metal reinforcement plates.

12. The refrigerated display case of claim 11, further comprising a plurality of support elements and wherein the canopy panel is attached to the plurality of support elements via the plurality of scrap metal reinforcement plates.

13. The refrigerated display case of claim 8, further comprising a tub positioned about the back panel.

14. The refrigerated display case of claim 8, wherein the back panel comprises a plurality of tapping plate spacers.

15. The refrigerated display case of claim 8, wherein the back panel comprises a plurality of corner parts in communication with the plurality of polystyrene support rails.

16. The refrigerated display case of claim 8, wherein the back panel comprises a unitary back panel and wherein the canopy panel comprises a unitary canopy panel.

17. A refrigerated display case, comprising:

a back panel;

a canopy panel;

the back panel and the canopy panel comprise a polyurethane foam core, a plurality of polystyrene support rails surrounding the polyurethane foam core in whole, a pair of liners positioned about the polyurethane foam core, a plurality of liner spacers extending between the pair of liners, and a plurality of reinforcement plates positioned about the polyurethane foam core; and wherein the back panel comprises a plurality of corner parts in communication with the plurality of polystyrene support rails.

* * * * *